United States Patent [19]

Amir et al.

[11] 4,367,459

[45] Jan. 4, 1983

[54] TAUT WIRE INTRUSION DETECTION SYSTEM AND DETECTORS USEFUL THEREIN

[76] Inventors: Yoel Amir, 71 Eshel, Moshav Omer; Omri Talmon, 34 Rambam St.; Chaim Porat, 21 Mivza-Horev St., both of Beersheva, all of Israel

[21] Appl. No.: 233,953

[22] Filed: Feb. 12, 1981

[30] Foreign Application Priority Data

Jun. 5, 1980 [IL] Israel ..... 60240

[51] Int. Cl.[3] ..... G08B 13/12

[52] U.S. Cl. ..... 340/541; 200/61.93; 340/668

[58] Field of Search ..... 340/541, 668, 548; 200/61.93

[56] References Cited

U.S. PATENT DOCUMENTS 1,238,363 8/1917 Vail ..... 340/548
1,995,082 3/1935 Stotts ..... 200/61.93
2,350,290 5/1944 Moore ..... 200/61.93

FOREIGN PATENT DOCUMENTS 1354057 5/1974 United Kingdom .
1450187 9/1976 United Kingdom .

*Primary Examiner*—Glen R. Swann, III
*Attorney, Agent, or Firm*—Benjamin J. Barish

[57] ABSTRACT

A taut wire type intrusion detection system includes an actuator common to a group of the tensioned wires, which actuator is adapted to actuate a detector upon a change in tension in any of the wires. In some described embodiments, the common actuator includes an actuator wire coupling the plurality of wires to the detector; and in other described embodiments, the common actuator includes an actuator bar coupling the plurality of wires to the detector. Also described is a detector in the form of a ceramic piezoelectric force transducer which outputs an electrical signal proportional to the force applied by the actuator.

23 Claims, 10 Drawing Figures

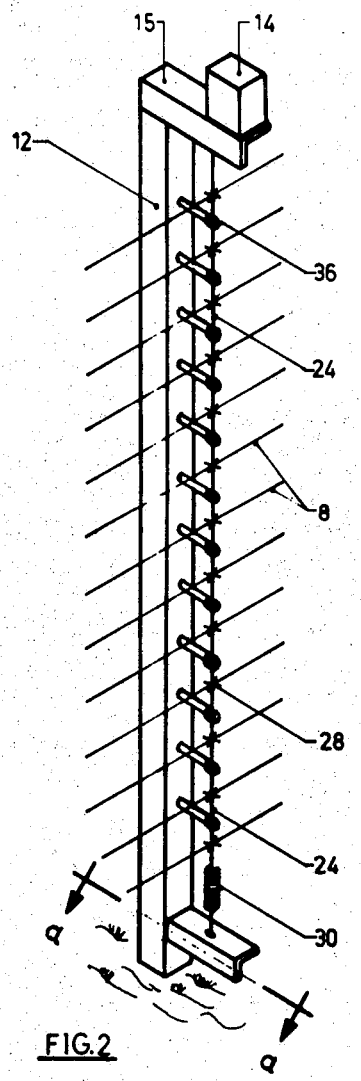
FIG. 2
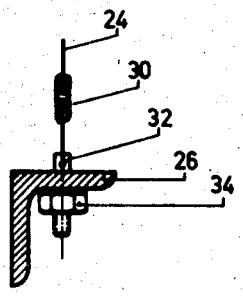
FIG. 2a
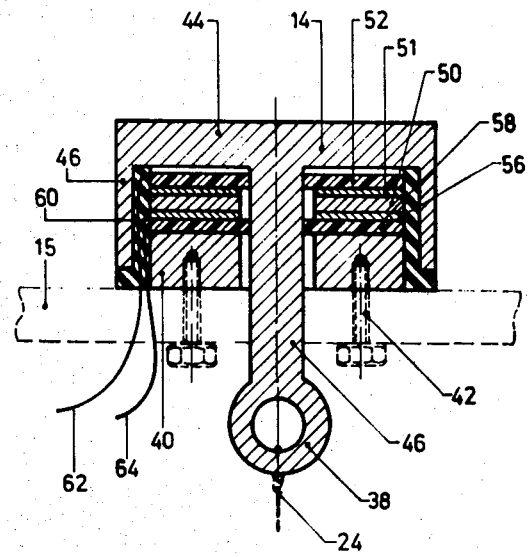
FIG. 3
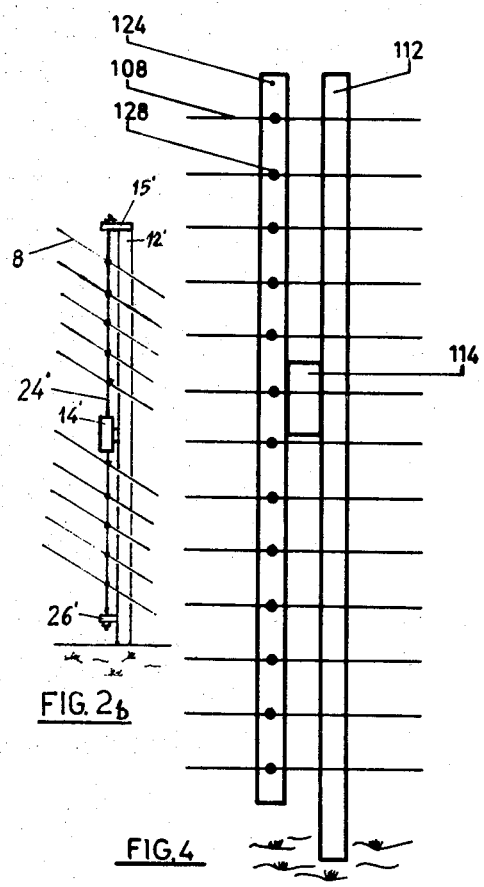
FIG. 2b
FIG. 4

TAUT WIRE INTRUSION DETECTION SYSTEM AND DETECTORS USEFUL THEREIN

BACKGROUND OF THE INVENTION

The present invention relates to the taut wire type intrusion detection system for detecting an unauthorized intrusion into a restricted area. The invention also relates to detector devices particularly useful in such intrusion detecting systems.

Many types of intrusion detectors and detection systems have been developed or proposed, including electrical switches mounted on a fence to detect any disturbance (e.g. cutting or moving) of the fence, photocell devices which detect the attempted intrusion by the interruption of a light beam, and antennae systems which detect the intrusion by the unbalancing of an electrical field in the area to be protected. As the need for such intrusion detection systems increases, efforts are continuously being made to decrease their cost and to increase their reliability.

BRIEF SUMMARY OF THE INVENTION

An object of the present invention is to provide a taut wire type intrusion detection system providing reliable operation and producible at low cost. Another object of the invention is to provide an intrusion detector particularly useful in such a system.

According to a broad aspect of the present invention, there is provided a taut wire type intrusion detection system comprising: a fence including a group of wires tensioned between a pair of wire-supporting poles anchored in the ground; a detector-carrier member supported intermediate the pair of wire-supporting poles; an intrusion detector fixed to the detector-carrier member; and a common actuator attached to a plurality of the tensioned wires and coupling same to the detector for actuating the detector upon detecting a disturbance in any of the plurality of wires.

In the preferred embodiments of the invention described below, the detector detects a change in tension in any of the wires; also, the detector carrier member includes an intermediate pole anchored in the ground intermediate the wire-supporting poles.

In some described embodiments, the common actuator includes an actuator wire coupling the plurality of wires to the detector. In other described embodiments, the common actuator includes an actuator bar coupling the plurality of wires to the detector.

Particularly good results have been obtained when the detector is a force transducer which produces an electrical output proportional to the force applied thereto by the common actuator. In the described embodiments, the detector is a ceramic piezoelectric transducer disc producing an electrical charge which is proportional to the force applied to it.

Further features and advantages of the invention will be apparent from the description below.

BRIEF DESCRIPTION OF THE DRAWINGS

The invention is herein described, by way of example only, with reference to the accompanying drawings, wherein:

FIG. 2 illustrates details of the detector carrier and actuating portion of the system of FIG. 1;

FIG. 2*a* is a sectional view along lines a—a of FIG. 2;

FIG. 2*b* is a view corresponding to that of FIG. 2 but illustrating a variation;

FIG. 3 is an enlarged transverse sectional view illustrating the construction of one form of detector which may be used for that of FIG. 2;

FIG. 4 illustrates the detector carrier and actuating portion of a second embodiment of intrusion detection system constructed in accordance with the invention;

DESCRIPTION OF PREFERRED EMBODIMENTS

Figure 1:
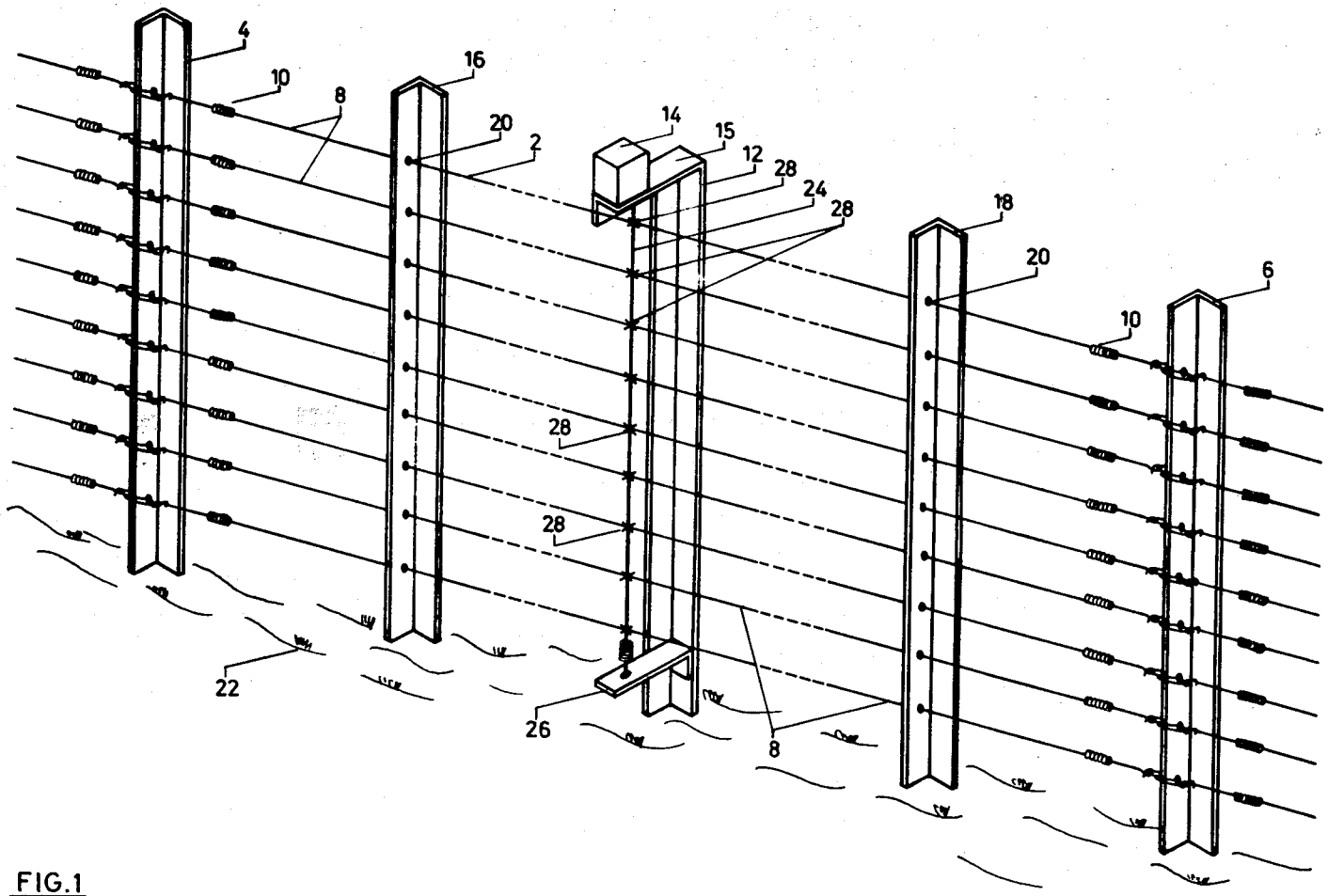
FIG. 1 is a three-dimensional view illustrating a section of one form of intrusion detection system constructed in accordance with the invention.

The section of the intrusion detection system illustrated in FIG. 1 comprises a fence, generally designated 2, including three types of fence poles, namely: wire-supporting poles 4, 6 between which a group of wires 8 are secured under tension by springs 10; a detector-carrier pole 12 supporting an intrusion detector 14 on a bracket 15 fixed to its upper end; and a pair of guiding poles 16, 18 located between the wire-supporting poles 4, 6 and the detector-carrier poles 12, and formed with openings 20 through which the wires 8 freely pass. All the above poles are anchored in the ground 22. If an intrusion is attempted, as by cutting one or more of the wires 8, or by displacing them for penetrating or climbing over the fence, detector 14 will be actuated in the manner to be described below. Accordingly, wires 8 serve as trip-wires which sense the attempted intrusion and actuate detector 14. These wires could also serve as the barrier wires of the fence, but usually the fence would include additional barrier wires (not shown in FIG. 1) such as the normal fence wire, barbed wire, or chain-link fence.

As mentioned above, detector 14 is actuated if any of the trip-wires 8 is disturbed. For this purpose, the system further includes a common actuator wire 24 extending along the detector-carrier pole 12 and fastened at its upper end to detector 14 and at its lower end to a bracket 26 fixed to the lower end of the detector-carrier pole 12. The common actuator wire thus extends perpendicularly to the trip-wires 8, and is secured alongs its length to these trip-wires, as shown at 28.

The detector-carrier pole 12, and the common actuator-wire 24 for actuating detector 14 supported by the pole, are more particularly illustrated in FIGS. 2 and 2*a;* whereas the structure of the detector 14, and the manner it is actuated by wire 24, are more particularly illustrated in FIG. 3.

As shown in FIGS. 2 and 2*a*, the lower end of the actuator wire 24 is secured to one end of a spring 30, the opposite end of the spring being secured to a pin 32 freely passing through an aperture in bracket 26. The lower end of pin 32 is threaded and receives a nut 34 which may be rotated to vary the tension applied to wire 24 by spring 30. Actuator wire 24 is guided along the length of pole 12 to the detector 14 by passing the wire through the eyes of a plurality of clips 36 fixed to pole 12 along its length. The upper end of wire 24 is attached to the eye of an operator member 38 (FIG. 3) of detector 14 fixed to the upper end of pole 12.

As shown in FIG. 3, detector 14 includes a housing made up of a first wall 40 secured to bracket 15 by fasteners 42, an opposed wall 44 integrally formed with a central stem 46 terminating in eye 38 constituting the operator member to which the upper end of the actuator wire 24 is secured, and an outer side wall 46 integral with wall 44. Interposed between the confronting faces of walls 40 and 44 is a force transducer 50 which outputs an electrical signal proportional to the force applied to it. Particularly good results have been obtained when transducer 50 is a ceramic piezoelectric disc which outputs an electrical charge proportional to force. An insulating disc 52 faced with a conductive coating 51 is interposed between one face of transducer disc 50 and housing wall 44, with the conductive coating 51 in contact with the transducer disc; and a second insulating disc 56 is interposed between the opposite face of the transducer disc and housing wall 40, with a conductive coating 58 on disc 56 in contact with the transducer disc 50. In addition, a resilient sealing ring 60, such as of rubber, is inserted within the detector housing between side wall 46 and the transducer disc 50. Lead-in electrical conductors 62, 64 are connected to the conductive coatings 51, 58 in contact with the opposite faces of the transducer disc 50 and are passed along, or through, the resilient seal 60.

Transducer disc 50, insulating discs 52, 56, and housing wall 40, are all formed with aligned central openings through which stem 46 of housing wall 44 freely passes. It will thus be seen that housing wall 44 is displaceable with respect to housing 40 so that actuator wire 24, secured to eye 38 at the lower end of stem 46, will apply a compressive force to the transducer disc 50 because of the tension applied to wire 24 by spring 30.

This compressive force applied to the transducer disc will be increased by a pulling of the wire which increases the tension thereof, and will be decreased by a relaxing of the wire which decreases the tension thereof. Accordingly, transducer disc 50 will output an electrical signal, via conductor 62, 64, in the form of an electric charge proportional to the force applied to it by the common actuator wire 24. Since the trip wires 8 are all attached under tension to the common actuator wire, a change in tension in any of the trip wires 8 will be translated as a change in the tension in the actuator wire 24, and therefore the output signal from the transducer disc 50 will be proportional to a change in tension on any of the trip wires 8.

The intrusion detection system illustrated in FIGS. 1–3 is installed in the following manner: First, all the fence poles 4, 6, 12, 16, 18, are anchored into the ground in the illustrated positions, with the detector-supporting pole 12 intermediate the wire-supporting poles 4, 6, and with the alignment poles 16, 18, interposed between the detector-supporting pole 12 and the wire-supporting poles 4, 6. The trip-wires 8 tensioned by springs 10 are passed through the openings 20 in the alignment poles 16, 18, and are attached to the wire-supporting poles 4, 6. As indicated above, the trip-wires 8 may serve also as the fence barrier wires, or additional fence barrier wires may be supported by the fence poles.

The detector 14 is fixed to bracket 15 on pole 12, and its operator (namely eye 38 of its stem 46) receives one end of the common actuator wires 24. The opposite end of the wire is passed through the eyes of clips 36 extending along the height of pole 12 and is attached to spring 30 at the bottom of pole 12. Nut 34 is rotated to vary the tension of wire 24 and thereby to pre-fix the operating range of the detector 14. After the operating range of the detector has been so pre-fixed, actuator wire 24 is connected along its length to all the trip-wires 8, as shown at 28. Any suitable means may be used for this purpose, for example, clips which are crimped at the intersection points 28 of wire 26 with the trip-wires 8, or wires which are twisted around these wires at the intersection points.

It will be seen that when the system has been so installed, and the operating range of detector 14 has been pre-fixed by adjusting the tension on the actuator wire 24, any variation in the force applied by actuator wire 24 to the operator 38 of the detector 14 will change the force applied to the transducer disc 50. Thus, an increase in tension on any one of the trip-wires 8 (e.g., by pulling, spreading-apart or cutting a trip-wire) will increase the tension on actuator wire 24 and thereby the force applied by it to the transducer disc 50; whereas a relaxation in the tension of any of the trip-wires 8 (e.g., by temperature changes or ground shift), will decrease the force applied to the transducer disc. The electrical output of the detector 14 is thereby proportional to the change in tension on any of the trip-wires 8.

Figure 8:
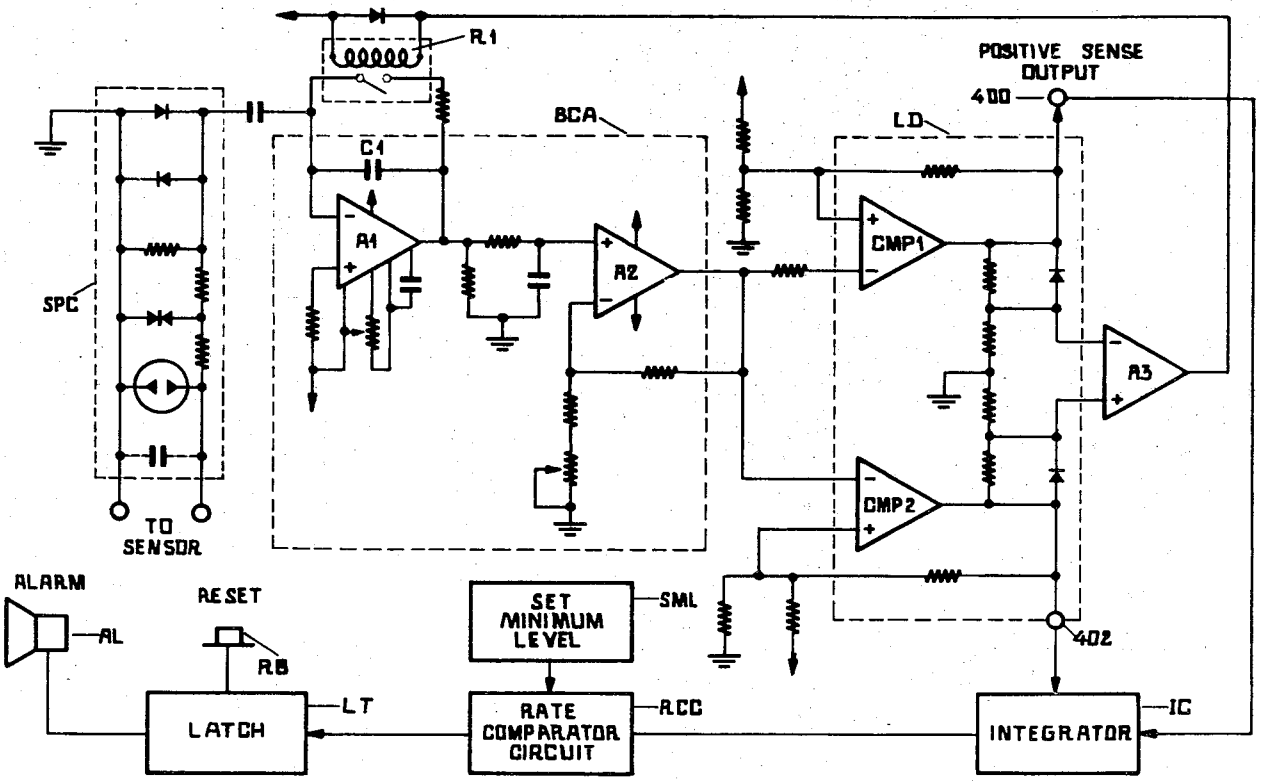
FIG. 8 is a block diagram illustrating one form of electrical circuit that may be used with the system of the invention.

The output of detector 14 is fed to an electrical circuit, such as illustrated in FIG. 8 and to be described below, which circuit determines whether the disturbance is caused by an attempted intrusion and if so, sets-off an alarm, or whether the disturbance is caused by a non-intrusion phenomenon and if so, ignores the electrical signal produced by the detector.

It will thus be seen that the system illustrated in FIGS. 1–3 provides an intrusion detection system involving a single detector for a plurality of trip-wires which is actuated by the disturbance of any one of the plurality of trip-wires, thereby substantially reducing the number of detectors needed for the fence. A further advantage is that by the use of a force transducer, particularly a ceramic piezoelectric transducer, a high degree of sensitivity and reliability of operation is attainable over a large dynamic range.

FIG. 2*b* illustrates a variation, wherein the detector 14′ is fixed at an intermediate point of the supporting pole 12′, and the actuator wire 24′ is tensioned between the detector and the elements 15′, 26′ fixed at the opposite ends of the supporting pole. The trip wires 8 are fixed to the two sections of the common actuator wire 24′ extending on the two opposite sides of the detector, so that any change in tension on the trip-wires is reflected by a change in tension on the common actuator wire 24′, and thereby on the output of the detector 14′.

Figure 5:
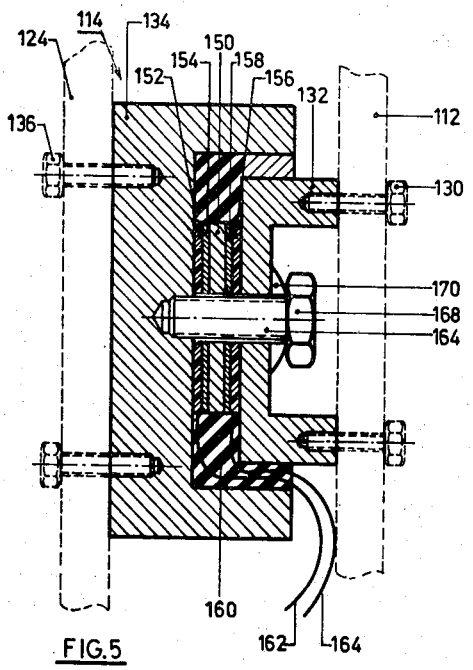
FIG. 5 is an enlarged transverse sectional view illustrating the construction of the detector in the embodiment of FIG. 4.

FIGS. 4 and 5 illustrate a second embodiment of the invention, wherein the common actuator attached to the trip-wires, instead of being an actuator wire, is in the form of a floating bar. As in the above-described system, the detector produces an output proportional to the change in tension on any of the trip wires.

More particularly, as shown in FIG. 4, the detector-supporting pole, therein designated at 112, supports the detector 114 at a mid-portion of the pole rather than at the top of the pole as in FIG. 1. A floating common-actuator bar 124 is attached to the opposite side of detector 114. Bar 124 is also attached along its length, as shown at 128, to the plurality of trip-wires 108.

As shown in FIG. 5, the detector 114 is secured to the fence pole 112 by means of fasteners 130 passing through a dished wall 132 of the detector housing. The floating actuating bar 124 is secured to the opposite wall 134 of the detector housing by means of fasteners 136. Interposed between the two housing walls 132 and 134 is the force transducer 150 which is also in the form of a ceramic piezoelectric disc as in the FIG. 3 embodiment described above. An insulating disc 152 faced with a conductive coating 154 in contact with transducer disc 150 is interposed between the transducer disc and housing wall 134, and a second insulated disc 156 faced with a conductive coating 158 in contact with the opposite face of the transducer disc 150 is interposed on the opposite side of the transducer disc. A resilient (e.g., rubber) seal 160 is interposed between the two housing walls 132 and 134. Electrical conductors 162, 164 from the conductive coatings 154, 158 in contact with the opposite faces of the transducer disc 150, are passed along or through seal 160. In addition, a pin 164 is freely passed through aligned openings formed in housing wall 132, transducer disc 150, and the insulating discs 154, 156, and the end of the pin is threaded into housing wall 134. The opposite end of pin 164 is formed with an enlarged head 168 disposed within the recess in housing wall 132, and a dome-shaped spring 170 is interposed between head 168 and housing wall 132.

The embodiment of the invention illustrated in FIGS. 4 and 5 is installed in the same manner as described above with respect to FIG. 1, except that the detector 114 is preset by turning the head 168 of pin 164 to prefix the force applied to the transducer disc 150, and thereby its operating range. When this has been so preset, the trip-wires 108 are attached to the common actuator bar 124 at points 128, as by welding or by the use of crimped clips. It will be seen that any change in tension on any one of the trip-wires 108 will cause the common actuator bar 124 to be displaced, and thereby to apply an increased or decreased compressive force to detector 114. Its transducer disc 150 will indicate this condition by outputting an electrical signal (via conductors 162, 164) in the form of an electrical charge proportional to the force applied to transducer disc 150, and thereby, proportional to the change in tension on any of the trip-wires 8.

Figure 6:
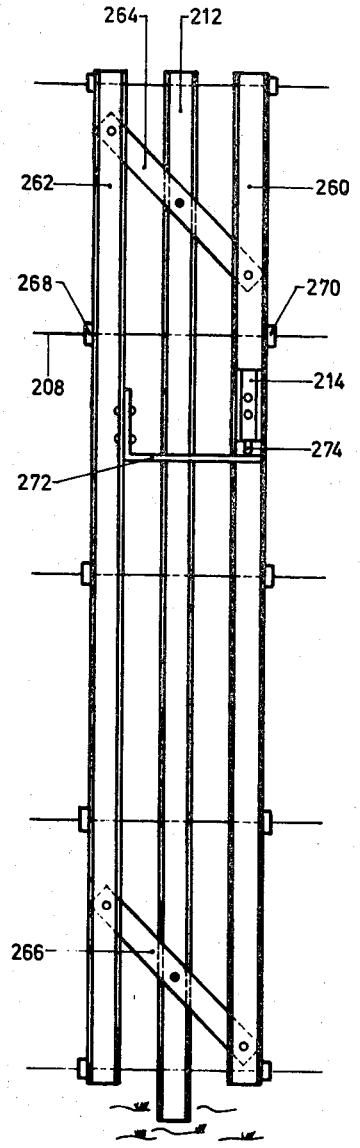
FIGS. 6 and 7 illustrate detector carrier and actuating arrangements in accordance with two further embodiments of the invention.

FIG. 6 illustrates a further arrangement that may be used for supporting and actuating the detector, therein generally designated 214. In this case, the detector 214 is not fixed directly to the intermediate fence pole 212 anchored in the ground, but is rather fixed to a floating bar 260 disposed on one side of the intermediate fence pole 212, there being a second floating bar 262 disposed on the opposite side of the pole. Both bars 260 and 262 are coupled to each other and to the intermediate fence pole 212 by a pivotal parallel linkage, namely links 264, 266 both pivoted at their mid-points to the intermediate fence pole 212 and at their outer points to the two floating bars 260, 262, such that when the two floating bars 260, 262 are forced toward or away from each other, they move together in opposite vertical directions.

The trip-wires 208 pass through openings in both of the floating bars 260, 262, and include stop elements 268 on the outboard side of floating bar 262, and further stop elements 270 on the outboard side of floating bar 260. An actuator bar 272 is secured to floating bar 262 and is engageable with an operator element 274 projecting from the detector 214 fixed to floating bar 260.

The arrangement illustrated in FIG. 6 operates as follows: If the tension on one or more of the trip-wires 208 is increased, e.g., pulling the wire leftwardly, stop elements 270 will move floating bar 260 also leftwardly, and the parallel links 264,266 will cause the floating bar 262 to move rightwardly. The leftward movement of floating bar 260 causes that bar, together with detector 214, to move downwardly in the vertical direction; and the rightward movement of floating bar 262 causes it, together with its actuator bar 272, to move upwardly in the vertical direction. Detector 214 is preferably of the force transducer type described above particularly with respect to FIG. 3, such that the differential movement between the actuator bar 272 of the detector 214 will produce an output electrical signal from the detector.

It will be appreciated that the same action occurs if a trip-wire 208 is tensioned rightwardly of the floating bars 260, 226 so as to pull the wire in the rightward direction, whereupon the wire displacement will be first transmitted by cable stop 268 to floating bar 262 and will then be converted by the parallel pivotal links 264, 266 to the same differential movement between the detector actuator bar 272 and the detector operator element 274 as described above.

Figure 7:
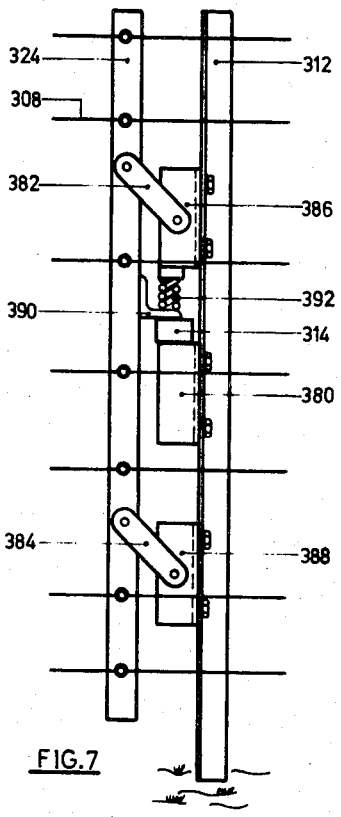

FIG. 7 illustrates a still further arrangement for supporting and actuating the detector by a change in tension in any of the trip-wires, except that in this case the detector is responsive to force directly and not to displacement. The arrangement illustrated in FIG. 7 is somewhat similar to that of FIG. 4, in that the trip-wires 308 are all attached to a common actuator bar 324 which is movable with respect to an intermediate fence pole 312 carrying the detector 314. In this case, however, the detector is supported on a ledge 380 fixed to the intermediate pole 312. In addition, the common actuator bar 324 is floatingly mounted with respect to the intermediate fence pole 312 by a pair of links 382, 384, each pivoted at one end to the common actuator bar 324 and pivoted at the opposite end to other ledges 386, 388 of the intermediate pole 312. The common actuator bar carries an actuator element 390 urged by a spring 392, interposed between it and the overlying ledge 386, to bear against the upper face of detector 314.

It will be seen that whenever the tension on any of the trip-wires 208 is changed, as by an attempted intrusion, this force will be transmitted, via the common actuator bar 324 and link 382, to actuator element 390 in the downward or upward direction, according to the direction of displacement of the trip-wire. An upward force on element 390 decreases the force applied to detector 314, and a downward force on element 390 increases the force applied to the detector. The detector will therefore output an electrical signal proportional to the change in tension on the trip-wires.

FIG. 8 illustrates an electrical circuit which may be used to process the electrical output from the detectors in the above-described systems. As mentioned above, since these detectors include ceramic piezoelectric transducers, their electrical outputs will be in the form of electric charges proportional to the force applied to the transducers by the respective actuator elements.

As shown in FIG. 8, the electrical charge signals are applied via a conventional surge-protection circuit SPC to a buffered charge amplifier BCA having a capacitor $C_1$ which stores the charges, an operational amplifier $A_1$ which produces a voltage proportional to the input charge, and a voltage amplifier $A_2$ which amplifies the electrical output. This output is applied to a level discriminator LD including two comparators $CMP_1$, $CMP_2$ which produce positive output pulses at output point 400 for minimum level charges of one sense (e.g.

positive), and negative output pulses at output point 402 for minimum level charges in the opposite sense (e.g. negative).

The output pulses from the level discriminator LD are fed via amplifier $A_3$ to a buffer discharge circuit including a relay $R_1$ which discharges capacitor $C_1$ in the buffered charge amplifier circuit BCA each time a pulse is outputted. The output pulses from level discriminator LD are also applied to an integrator circuit IC which algebraicly sums the pulses, and then to a rate comparator circuit RCC which compares the rate of arrival of the pulses with a preset minimum rate from a set minimum level circuit SML. If the rate exceeds the preset rate, a latch LT is actuated to energize an alarm AL. Latch LT may be reset for reset button RB.

An important advantage in using a ceramic piezoelectric transducer is that it provides high sensitivity with wide dynamic range. That is to say, the transducer outputs an electrical charge which is proportional to the force over a large, substantially linear range. Thus, if a force is applied to the detector gradually, e.g. by temperature change or ground shift, this will be ignored by the system, and it will continue to remain effective. If a large force is applied suddenly, e.g. by the cutting or pulling one of the trip-wires, this condition will be immediately signalled by the detector and the signalling circuit illustrated in FIG. 8. In addition, the detector and the signalling circuit will still remain effective to detect and signal any subsequent disturbances of any of the other trip-wires. Wind forces which tend to move the wires in both directions, will tend to be ignored by the circuit of FIG. 8. as they will tend to cancel each other in the integrator IC.

While the illustrated systems include only one detector actuated by a common actuator connected to all the trip-wires, it will be appreciated that two or more detectors could be provided, e.g., one controlled by a plurality of wires at the top of the fence and another controlled by a plurality of wires at the bottom of the fence. Also, particularly in the embodiments of FIGS. 1–3, the springs 30, and/or the wire guide 36, may be omitted. In addition, other detectors may be used in the disclosed system.

Further, the system may be used for detecting disturbances other than changes in wire tension, for example, vibrations in the trip-wires.

Many other variations, modifications and applications of the invention will be apparent.

What is claimed is:

1. An intrusion detection system comprising: a fence including a group of wires tensioned between a pair of wire-supporting poles anchored in the ground; a detector-carrier member supported intermediate said pair of wire-supporting poles; an intrusion detector fixed to said detector-carrier member; and a common actuator attached to a plurality of said wires and coupling same to said detector for actuating the detector in response to a disturbance in any of said plurality of wires.

2. A system according to claim 1, wherein said detector detects a change in tension in any of said plurality of wires.

3. A system according to claim 1, wherein said detector-carrier member includes an intermediate pole anchored in the ground intermediate said wire-supporting poles.

4. A system according to claim 3, wherein said common actuator includes an actuator wire coupling said plurality of wires to said detector.

5. A system according to claim 4, wherein said detector is fixed at one end of said intermediate pole, and said actuator wire is tensioned between said detector and an element fixed at the other end of said intermediate pole.

6. A system according to claim 4, wherein said detector is fixed at an intermediate point on said intermediate pole, and said actuator wire includes a section on the two opposite sides of said detector, each section being connected to the tensioned wires on its respective side of the detector.

7. A system according to claim 3, wherein said common actuator includes an actuator bar coupling said plurality of wires to said detector.

8. A system according to claim 7, wherein said actuator bar is a floating bar disposed parallel to said intermediate pole, one side of said detector being secured to said intermediate pole, said floating actuator bar being secured to the opposite side of the detector.

9. A system according to claim 7, further including a pair of floating bars disposed on opposite sides of said intermediate pole and coupled to it and to each other by pivotal parallel linkage such that they move together in opposite vertical directions; one of said floating bars being coupled to said plurality of wires so as to be moved in one direction thereby when one of said wires is moved in said one direction, and the other of said floating bars being coupled to said plurality of wires so as to be moved in the opposite direction whereby when one of said wires is moved in said opposite direction; said actuator bar being carried by one of said floating bars, and said detector being carried by the other of said floating bars.

10. A system according to claim 7, wherein said actuator bar is a floating bar disposed parallel to said intermediate pole and pivotably mounted thereto so as to move in a vertical direction upon a change in tension in any of the wires, said intermediate pole including a horizontal ledge engageable with one side of said detector, said floating bar including a horizontal actuator element engaging the opposite side of said detector by a change in tension in any of said wires.

11. A system according to claim 1, further including guiding poles between said wire-supporting poles and said detector-carrier member, said guiding poles being provided with openings through which said wires freely pass.

12. A system according to claim 1, wherein said detector is a force transducer which outputs an electrical signal proportional to the force applied thereto by said actuator.

13. A system according to claim 12, wherein said actuator is a wire and includes means for adjusting the tension thereof to preset the operating range of the detector.

14. A system according to claim 12, wherein said force transducer includes means for pre-adjusting the force applied thereto to preset the operating range of the detector.

15. A system according to claim 12, wherein said force transducer is a ceramic piezoelectric transducer which outputs an electrical charge proportional to the force applied thereto by said actuator.

16. A system according to claim 15, wherein said ceramic piezoelectric transducer is substantially in the configuration of a disc and is disposed within a housing having one wall anchored to a fixed support and an opposite wall displaceable with respect thereto and mechanically coupled to said actuator so as to apply a compressive force to the transducer disc upon the displacement of said actuator.

17. A system according to claim 16, wherein said ceramic piezoelectric transducer disc and said one wall of the housing are formed with aligned openings, said opposite wall of the housing including an operator element extending through said aligned openings and attached to the actuator.

18. A system according to claim 17, wherein said opposite housing wall further includes a side wall enclosing said transducer disc and said one wall of the housing, the housing further including a resilient seal between said side wall, and said transducer disc and the one housing wall enclosed thereby.

19. A system according to claim 16, wherein said transducer disc and said one wall of the housing are formed with aligned openings, there being a pin freely passing through said aligned openings, said pin having a head disposed on the outer face of said one wall and a threaded end threaded into said opposite wall.

20. A system according to claim 19, further including a spring interposed between said head of the fastener and said one wall for preadjusting the force applied to the transducer disc to preset the operating range of the detector.

21. A system according to claim 19, further including a resilient seal interposed between said housing walls and enclosing the transducer disc disposed therein.

22. A system according to claim 12, further including a buffered charge amplifier having a capacitor for storing the electrical charges outputted by the force transducer and an amplifier for amplifying same; a level discriminator producing positive pulses for minimum level charges of one sense, and negative pulses for minimum level charges of the opposite sense; an accumulator algebraicly accumulating said pulses; a rate comparator comparing the rate of accumulation of said pulses with respect to a minimum rate; and a signalling device actuated upon the rate of said pulses exceeding said minimum rate.

23. A system according to claim 22, further including a buffer discharge circuit effective to discharge the capacitor of the buffered amplifier by each pulse from the level discriminator.

* * * * *